US010095251B1

(12) United States Patent
Fu et al.

(10) Patent No.: US 10,095,251 B1
(45) Date of Patent: Oct. 9, 2018

(54) VOLTAGE REGULATING CIRCUIT

(71) Applicant: United Microelectronics Corp., Hsinchu (TW)

(72) Inventors: Chai-Wei Fu, Chiayi (TW); Cheng-Hsiao Lai, Chiayi County (TW); Ying-Ting Lin, Hsinchu County (TW); Yuan-Hui Chen, Hsinchu (TW); Ya-Nan Mou, Hsinchu (TW); Yung-Hsiang Lin, Hsinchu (TW); Hsueh-Chen Cheng, Hsinchu County (TW)

(73) Assignee: United Microelectronics Corp., Hsinchu (TW)

( * ) Notice: Subject to any disclaimer, the term of this patent is extended or adjusted under 35 U.S.C. 154(b) by 0 days.

(21) Appl. No.: 15/607,266

(22) Filed: May 26, 2017

(30) Foreign Application Priority Data

Apr. 10, 2017 (TW) ..... 106111858 A

(51) Int. Cl.
*G05F 1/44* (2006.01)
*G05F 1/46* (2006.01)
(Continued)

(52) U.S. Cl.
CPC ..... *G05F 1/44* (2013.01); *G05F 1/465* (2013.01); *G05F 1/467* (2013.01); *G05F 1/468* (2013.01); *G05F 1/562* (2013.01); *G05F 1/575* (2013.01)

(58) Field of Classification Search
CPC . H02M 2001/0032; H02M 2001/0045; H02M 3/156; H02M 3/1584; H02M 3/1588; H02M 3/158; H02M 3/1582; H02M 3/073; Y02B 70/16; Y02B 70/1466; G05F 1/59; G05F 1/56; G05F 1/575; G05F 1/465;
(Continued)

(56) References Cited

U.S. PATENT DOCUMENTS 5,086,238 A * 2/1992 Watanabe ..... G11C 5/147 323/314
5,336,986 A * 8/1994 Allman ..... G05F 3/262 307/80

(Continued)

FOREIGN PATENT DOCUMENTS

CN 101042592 9/2007

*Primary Examiner* — Jue Zhang
*Assistant Examiner* — Kevin H Sprenger
(74) *Attorney, Agent, or Firm* — J.C. Patents

(57) ABSTRACT

A voltage regulating circuit provides a feedback voltage and an output voltage based on a power voltage. The voltage regulating circuit includes a reference voltage generator and a compensating circuit. The reference voltage generator receives the power voltage, produces the feedback voltage, and includes an impedance having first and second terminals. The second terminal is coupled to a ground voltage and a first current flows through the impedance at the first terminal to produce the feedback voltage. The compensating circuit includes a negative threshold voltage (NVT) transistor having a source terminal, a drain terminal and a gate terminal. The source terminal receives a power voltage, the drain terminal is connected to the gate terminal and coupled to the first terminal of the impedance through a path to add a second current to the first current when the NVT transistor is turned on under an operational condition at the FF corner.

12 Claims, 4 Drawing Sheets

(51) Int. Cl.
*G05F 1/575* (2006.01)
*G05F 1/56* (2006.01)

(58) Field of Classification Search
CPC ..... G05F 1/565; G05F 1/595; G05F 1/573; G05F 1/563; G05F 3/30; G05F 1/44
USPC ..... 323/268–272, 281
See application file for complete search history.

(56) References Cited

U.S. PATENT DOCUMENTS

| | | | | |
|---|---|---|---|---|
| 6,114,843 | A * | 9/2000 | Olah | G05F 1/465 323/280 |
| 6,815,941 | B2 | 11/2004 | Butler | |
| 7,321,256 | B1 | 1/2008 | Vasudevan | |
| 2003/0123522 | A1* | 7/2003 | Hsu | G01K 7/015 374/185 |
| 2017/0093272 | A1* | 3/2017 | Wakaiki | G11C 5/145 |

* cited by examiner

VOLTAGE REGULATING CIRCUIT

CROSS-REFERENCE TO RELATED APPLICATION

This application claims the priority benefit of Taiwan application serial no. 106111858, filed on Apr. 10, 2017. The entirety of the above-mentioned patent application is hereby incorporated by reference herein and made a part of this specification.

BACKGROUND OF THE INVENTION

1. Field of the Invention

The invention relates to a voltage regulating circuit.

2. Description of Related Art

Due to different operating mechanisms, the system voltages of electronic circuits with different functions may differ. For example, the system voltages may be 3.3V or 1.2V. Regarding a voltage control circuit controlling power, such as a regulating circuit, a higher single voltage may be opted for, and a lower voltage may be obtained by using a reference voltage generator.

The design of the regulating circuit may include field effect transistors (FET). The transistors are manufactured by applying semiconductor manufacturing technologies. However, due to manufacturing reasons, the transistors may be offset, making the circuit performance unstable. For example, under some operational conditions, the performance of the transistors of the circuit may be varied, thus changing the voltage regulating effect or the voltage lowering effect. The circuit may consequently become unstable. For example, under an operational condition at a Fast-Fast (FF) corner, the circuit may be unstable, making the voltage source output through the reference voltage generator offset and unstable. A fast corner is an operational condition with a high dopant concentration.

How to reduce the offset of the regulator under the operational condition at the F-F corner remains an issue of voltage regulation.

SUMMARY OF THE INVENTION

The invention provides a voltage regulating circuit configured to provide a feedback voltage and a regulating voltage based on a power voltage. The voltage regulating circuit keeps a less significant voltage offset under an operational condition at an FF corner to provide a more stable voltage regulating effect.

According to an embodiment of the invention, a voltage regulating circuit comprises a reference voltage generator, a compensating circuit and an output circuit. The reference voltage generator comprises a comparator, a first control switch and an impedance. The first control switch and the impedance are serially connected between a power voltage and a ground voltage. A first current is fed from the first control switch to the impedance to produce a feedback voltage on a terminal of the impedance. The feedback voltage is fed back to the comparator for comparison with a reference voltage. The comparator produces a control voltage to control the first control switch for adjusting the first current. The compensating circuit comprises a negative threshold voltage transistor and a second control switch, wherein the negative threshold voltage transistor and the second control switch are serially connected between the power voltage and feedback voltage. The control voltage controls the second control switch to generate a second current added to the first current and fed into the impedance. The output circuit comprises a third control switch and a fixed current source, wherein the third control switch and the fixed current source are serially connected between the power voltage and the ground voltage, wherein the control voltage controls the third control switch to generate a regulating voltage between the third control switch and the fixed current source.

According to an embodiment of the invention, in the voltage regulating circuit, the first control switch is a transistor switch, and the transistor switch is turned on when the first current is produced in the reference voltage generator.

According to an embodiment of the invention, in the voltage regulating circuit, the transistor switch is also a negative threshold voltage transistor.

According to an embodiment of the invention, the power voltage respectively applied to the reference voltage generator, the compensating circuit and the output circuit is same or different.

According to an embodiment of the invention, in the voltage regulating circuit, the first control switch of the reference voltage generator is a first transistor switch and has a second source terminal, a second drain terminal, and a second gate terminal. The second source terminal receives the power voltage, and the second gate terminal is connected to the output terminal of the comparator. In addition, the first terminal of the impedance is connected to the second drain terminal.

According to an embodiment of the invention, in the voltage regulating circuit, the second control switch of the compensating circuit is a second transistor switch.

According to an embodiment of the invention, in the voltage regulating circuit, at least one of the first transistor switch and the second transistor switch is a negative threshold voltage transistor.

According to an embodiment of the invention, in the voltage regulating circuit, the third control switch of the output circuit is a third transistor switch having a third source terminal, a third drain terminal, and a third gate terminal. The third source terminal receives the power voltage, the third gate terminal is connected to the output terminal of the comparator, and the third drain terminal is connected to the fixed current source.

According to an embodiment of the invention, in the voltage regulating circuit, at least one of the first transistor switch, the second transistor switch, and the third transistor switch is a negative threshold voltage transistor.

According to an embodiment of the invention, in the voltage regulating circuit, the power voltage respectively applied to the reference voltage generator, the compensating circuit and the output circuit is same or different.

According to an embodiment of the invention, in the voltage regulating circuit, the negative threshold voltage transistor (208) is turned on and produces a second current (I2) under an operational condition that an N-type transistor has a high dopant concentration.

According to an embodiment of the invention, in the voltage regulating circuit, a current flowing through the impedance is a sum of the first current and the second current in stable state, to compensate a current offset caused by a high dopant concentration as fabricated.

Based on the above, the compensating circuit is adopted in the embodiments of the invention, and is turned on based on the negative threshold voltage transistor under the operational condition at the FF corner to compensate a current. The current flows through the impedance to maintain a higher output voltage. Accordingly, the output voltage of the FF corner is closer to the output voltages of other corners.

In order to make the aforementioned and other features and advantages of the invention comprehensible, several exemplary embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
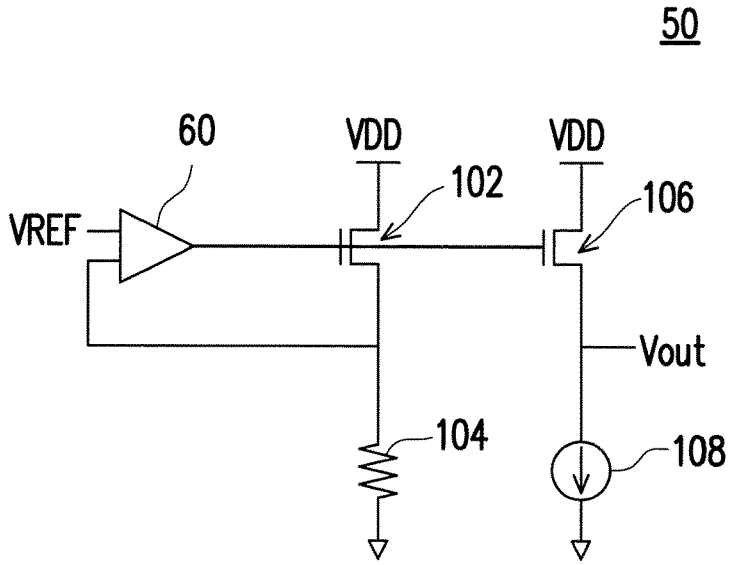
FIG. 1 is a schematic diagram illustrating a regulating circuit according to the invention.

Reference will now be made in detail to the present preferred embodiments of the invention, examples of which are illustrated in the accompanying drawings. Wherever possible, the same reference numbers are used in the drawings and the description to refer to the same or like parts.

In a design of a regulating circuit of the invention, a negative threshold voltage transistor is proposed to add a compensating circuit. When the regulating circuit is operated at an FF corner, the compensating circuit is turned on to provide a compensating current. Accordingly, a lowering offset of an output voltage of the regulating circuit may be reduced when operated at the FF corner.

The following will describe some embodiments as examples of the invention, however the invention is not limited by the embodiments.

FIG. 1 is a schematic diagram illustrating a regulating circuit according to the invention. Referring to FIG. 1, a basic framework of a regulating circuit 50 considered in the invention includes a comparator 60, a transistor 102, a transistor 106, and an impedance 104, and is capable of providing a fixed current source 108 or an output voltage Vout to an external circuit. The output voltage Vout in use can also be referred as the regulating voltage. The transistors 102 and 106 are common metal-oxide-semiconductor (MOS) transistors, and gates of the transistors 102 and 106 are turned on under control of the comparator 60. The comparator 60 determines an output voltage based on a reference voltage REF and a voltage fed back by the transistor 102. First source terminals of the transistors 102 and 106 are connected to the system voltage VDD. A voltage of the impedance 104 is mirrored as the output voltage Vout. This output terminal for outputting the output voltage Vout may serve as a current source 214 providing a current to an external circuit as needed.

The design of the voltage regulating circuit 50 includes properties of transistors, and the properties of the transistors may be offset during manufacturing. The offset is normally more obvious under an operational condition at the FF corner, and the circuit may thus become less stable. Details regarding corners such as SS, FF, FS, and SF of the operational conditions will be described in the following with reference to FIG. 3.

Figure 2:
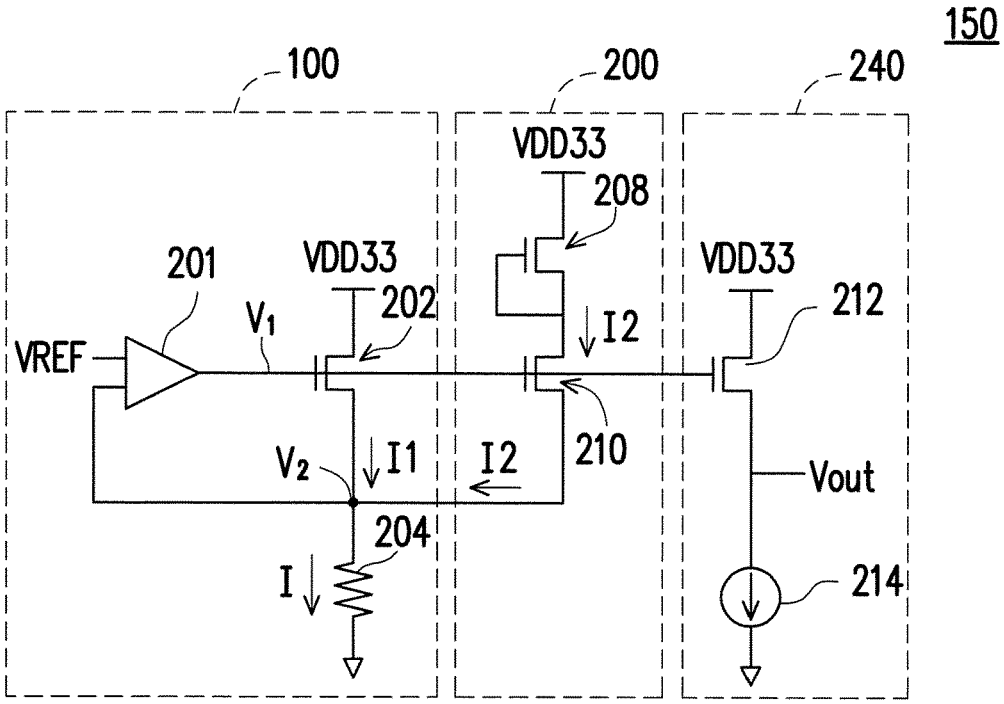
FIG. 2 is a schematic diagram illustrating a regulating circuit according to an embodiment of the invention.

With at least the consideration that the output voltage is lowered when the voltage regulating circuit 50 is operated at the FF corner, the invention proposes a design with a compensating circuit. FIG. 2 is a schematic diagram illustrating a regulating circuit according to an embodiment of the invention.

Referring to FIG. 2, according to an embodiment, a voltage regulating circuit 150 includes a reference voltage generator 100, a compensating circuit 200, and an output circuit 240. The reference voltage generator 100 of the voltage regulating circuit 150 includes a comparator 201, a first control switch 202, and an impedance 204, for example. The first control switch 202 is a transistor circuit, for example. The compensating circuit 200 includes a negative threshold voltage (NVT) transistor 208 and a second control switch 210. The output circuit 240 includes a third control switch 212 and a fixed voltage source 214. An output of the regulating circuit 150 may serve as the fixed current source 214 to provide a current or serve as a voltage source to provide the output voltage Vout to an external circuit. The output voltage Vout in use can also be referred as the regulating voltage. The first control switch 202, the second control switch 210, and the third control switch 212 are transistor switches, for example, and are controlled by an output terminal of the comparator 201. The output terminal of the comparator 201 provides the control voltage V1 for the control.

According to an embodiment, a more specific circuit connection framework of the reference voltage generator 100 of the regulating circuit 150 includes the comparator 201 receiving the reference voltage VREF and a feedback voltage fed back from a first terminal of the impedance. The first control switch 202 is a transistor switch, for example, and has a source terminal, a drain terminal, and a gate terminal. The source terminal receives a power voltage VDD33, such as a system high voltage VDD, and the gate terminal is coupled to the output terminal of the comparator 201. The first terminal of the impedance 204 is coupled to the drain terminal of the first control switch 202. Since a current I1 output by the drain terminal of the first control switch 202 flows through the impedance 204, the feedback voltage V2 that is fed back is produced at the first terminal of the impedance 204. When the compensating circuit 200 is not turned on, the current I1 is equal to a current I, i.e., the current flowing through the impedance 204. The feedback voltage V2 is thus produced.

The third control switch 212 of the compensating circuit 240 is a transistor switch, for example, and has a source terminal, a drain terminal, and a gate terminal. The source terminal receives the power voltage VDD33, the gate terminal is coupled to the output terminal of the comparator 210, and the drain terminal provides the output current to serve as the fixed voltage source 214 and the output voltage Vout obtained by mirroring the feedback voltage V2.

In an embodiment, the compensating circuit 200 of the invention includes the negative threshold voltage transistor 208 having a source terminal, a drain terminal, and a gate terminal. In addition, the source terminal receives another system voltage that may be the system high voltage VDD, for example, or other voltages and is referred to as a power voltage VDD33. In other words, the power voltage in the compensating circuit 200 may be different from the power voltage in reference voltage generator 10 0 or the output circuit 240. The drain terminal is connected to the gate terminal, and is coupled to the first terminal of the impedance 204. The path includes the second control switch 210, for example. Hence, when the negative threshold voltage transistor 208 is turned on under an operational condition at the Fast-Fast (FF) corner, the second current I2 is added to the first current I1 to obtain the current I flowing through the impedance 204. Under such circumstance, the feedback voltage V2 includes compensation of the second current I2.

Figure 3:
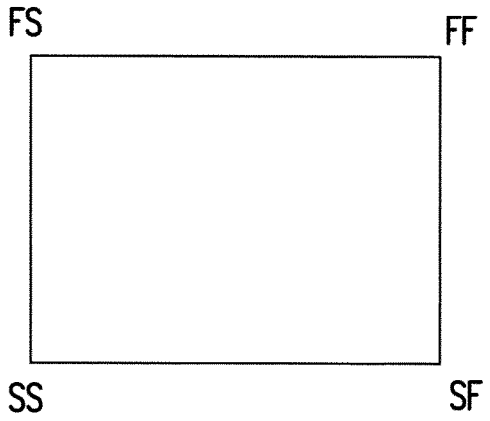
FIG. 3 is a schematic view illustrating a plurality of operational corners according to an embodiment of the invention.

Definitions of respective corners are described in the following. FIG. 3 is a schematic view illustrating a plurality of operational corners according to an embodiment of the invention. Referring to FIG. 3, a full-fledged integrated circuit includes an N-type MOS (NMOS) transistor and a P-type MOS (PMOS) transistor. Switching speeds for turning on and off the NMOS transistor and the PMOS transistor respectively include a slow (S) operational state and a fast (F) operational state. "Slow (S)" and "fast (F)" respectively refer to operational conditions of the transistor in a high dopant concentration and a low dopant concentration. The preceding letter represents an operational state of the NMOS transistor, whereas the following letter represents an operational state of the PMOS transistor. Accordingly, there are four areas in terms of the operational conditions, namely the SS, FS, SF, and FF corners. In addition, the FF corner indicates that the switching speeds of the NMOS transistor and the PMOS transistor are "fast (F)". In the regulating circuit 50 of FIG. 1, the output voltage Vout or the feedback voltage V2 at the FF corner may be offset and lowered, making the output voltage insufficient, for example.

According to an embodiment, the negative threshold voltage transistor 208 is adopted to form the compensating circuit 206 in the invention. Properties of the negative threshold voltage transistor 208 are described in the following. A threshold voltage (VT) of the negative threshold voltage transistor 208 is positive under a normal operational condition. However, in an operation at the FF corner, the threshold voltage of the negative threshold voltage transistor 208 becomes negative.

Figure 4:
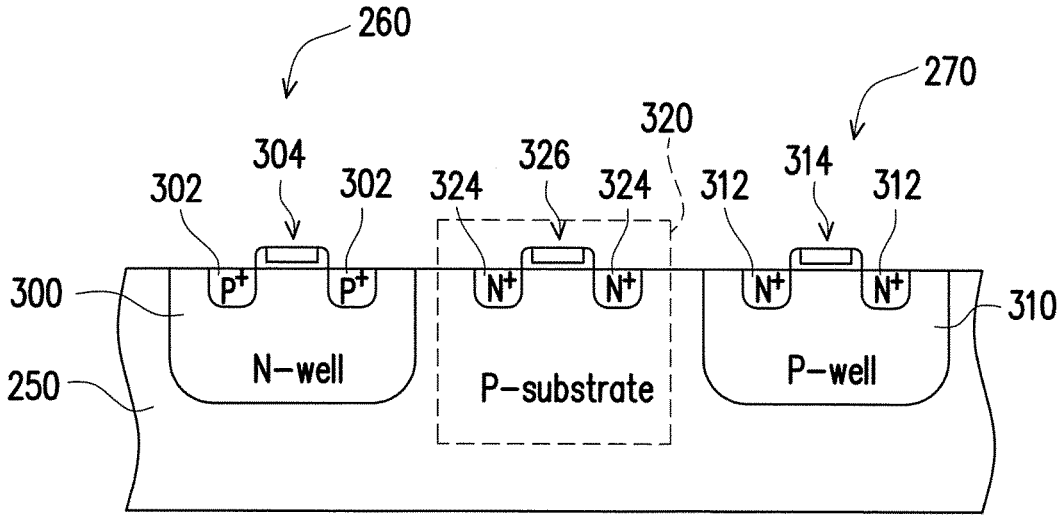
FIG. 4 is a schematic view illustrating cross-sectional structures of a plurality of transistors according to an embodiment of the invention.

FIG. 4 is a schematic view illustrating cross-sectional structures of a plurality of transistors according to an embodiment of the invention. Referring to FIG. 4, a PMOS transistor 260, an NVT transistor 320, and an NMOS transistor 270 may be formed on a substrate 250, for example. The substrate 250 is a P-type substrate, for example. The PMOS transistor 260 is formed in an N-well region 300 and includes a gate structure 304 and two source/drain terminals 302. The NMOS transistor 270 is formed in a P-well region 310 and includes a gate structure 314 and two source/drain terminals 312. The NVT transistor 320 is similar to the NMOS transistor 270, but does not include the P-well region 310. The NVT transistor 320 includes a gate structure 326 and two source/drain terminals 324 formed on the substrate 250. Since the NVT transistor 320 does not have the P-well region 310, when the operation is at the FF corner, the threshold voltage of the NVT transistor 320 may become negative.

Figure 5:
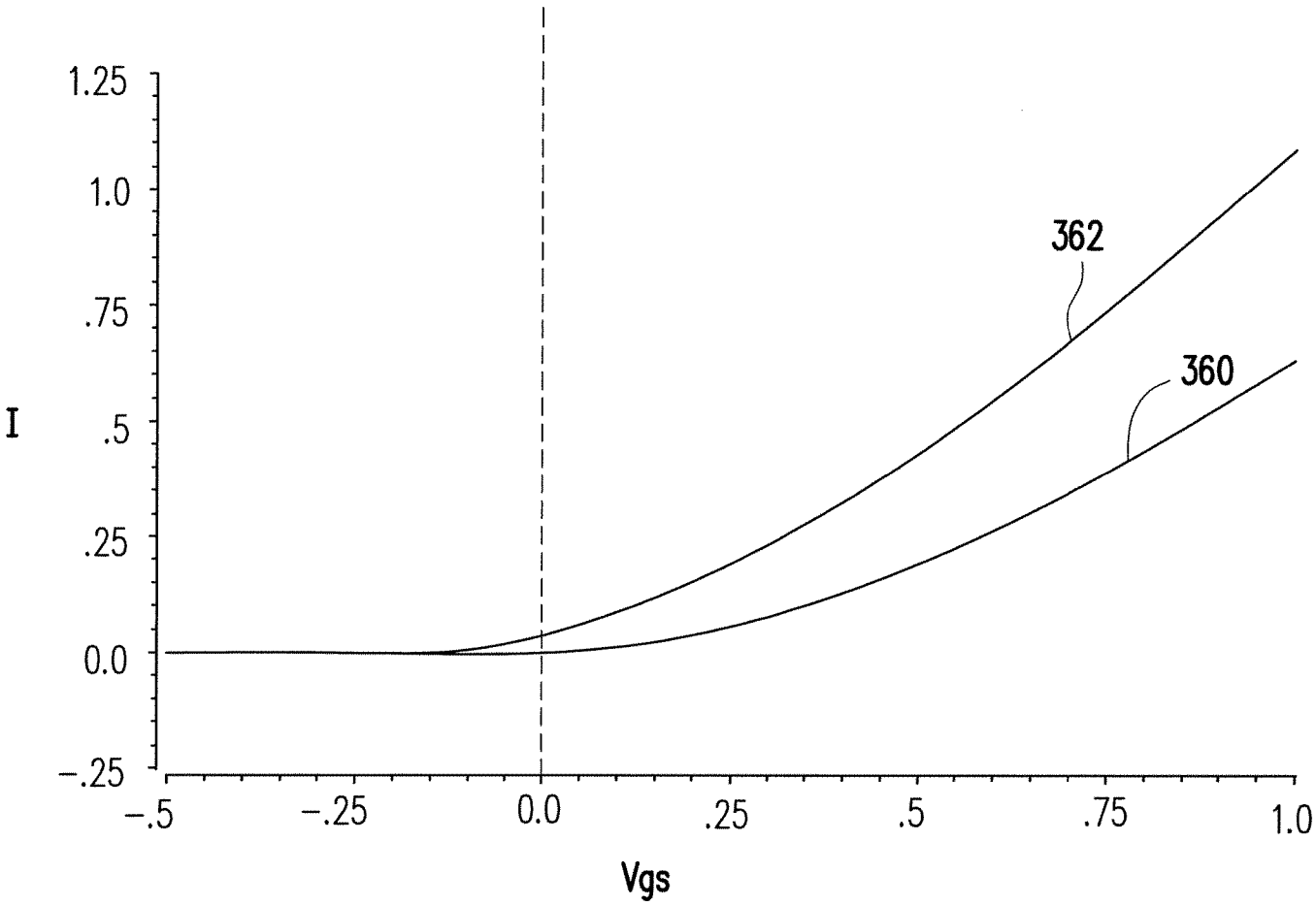
FIG. 5 is a schematic diagram illustrating variation of an I-V curve of a negative threshold voltage transistor at an SS corner and an FF corner according to an embodiment of the invention.

FIG. 5 is a schematic diagram illustrating variation of an I-V curve of a negative threshold voltage transistor at an SS corner and an FF corner according to an embodiment of the invention. Referring to FIG. 5, a curve 360 is an I-V curve of the NVT transistor 320 at the SS corner, where the horizontal axis represents Vgs, and the vertical axis represents current. Here, values of I and V are merely qualitative not the absolute values. A curve 362 is an I-V curve of the NVT transistor 320 at the FF corner where the threshold voltage of the NVT transistor 320 becomes negative.

In the compensating circuit 200 of FIG. 2, the source/drain terminals of the NVT transistor 208 are connected to the gate terminal thereof. Thus, under the operational conditions at the SS corner, the FS corner, and the SF corner, the NVT transistor 208 is not turned on. Under such circumstance, the current I1 is equal to the current I and flows through the impedance 204 to produce the feedback voltage V2. However, when the voltage regulating circuit 150 is located at the FF corner, the NVT transistor 208 of the compensating circuit 200 is turned on due to the negative threshold voltage. By turning on the second control switch 210 under the control of the comparator 201, the compensating circuit 200 is turned on to provide the compensating second current I2 to the first current I1. Under such circumstance, the current I flowing through the impedance 204 is greater than the first current I1, and may produce a greater output voltage.

Here, the power voltage VDD33 respectively applied to the reference voltage generator 100, the compensating circuit 200, and the output circuit 240 may be the same in an embodiment. However, the power voltage VDD33 respectively applied to the reference voltage generator 100, the compensating circuit 200, and the output circuit 240 may be different in another embodiment. Also, in an embodiment, at least one of the first control switch 202, the second control switch 210, and the third control switch 212 may adopt the design of the NVT transistor.

Figure 6:
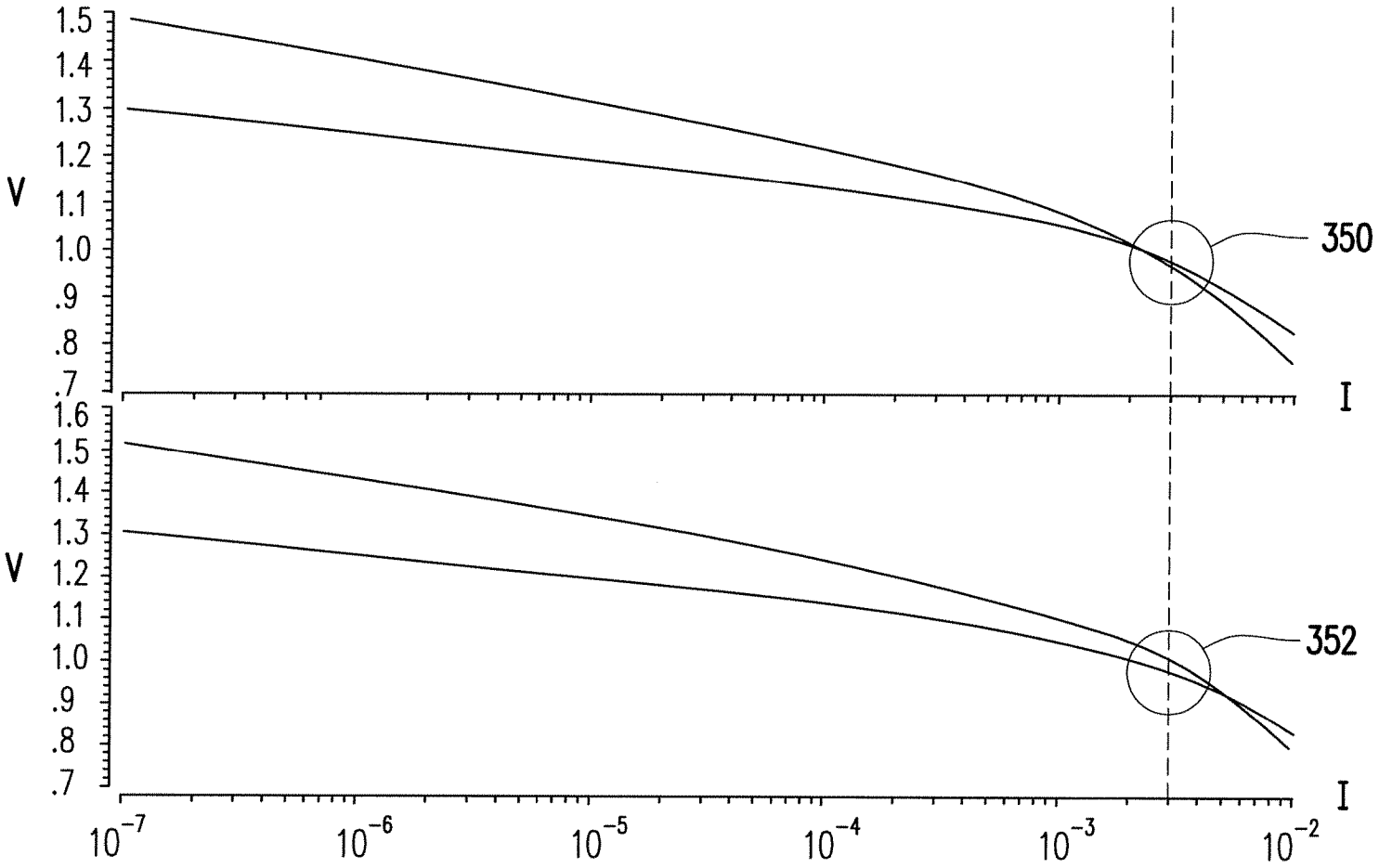
FIG. 6 is schematic diagram illustrating simulated performances of the circuits of FIGS. 1 and 2 according to an embodiment of the invention.

FIG. 6 is schematic diagram illustrating simulated performances of the circuits of FIGS. 1 and 2 according to an embodiment of the invention. Referring to FIG. 6, an expected output current is 3 mA, for example, as marked by the broken line. The upper part of the figure represents the circuit of FIG. 2 with the design of the compensating circuit 200. According to the two curves of the SS corner and the FF corner, the output voltages are close at an area 350, and there is no significant offset. The lower part of the figure represents the circuit of FIG. 1 with the design without the compensating circuit. According to the two curves of the SS corner and the FF corner, the output voltages at an area 352 are clearly separated from each other. The output voltage at the FF corner shows a greater offset.

In the design of the regulating circuit of the invention, the negative threshold voltage transistor is proposed to add the compensating circuit. When the regulating circuit is operated at the FF corner, the compensating circuit is turned on to provide a compensating current. Accordingly, the offset of the output voltage of the regulating circuit when operated at the FF corner may be reduced.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A voltage regulating circuit, comprising:

a reference voltage generator, comprising a comparator, a first control switch and an impedance, wherein the first control switch and the impedance are serially connected between a power voltage and a ground voltage, wherein a first current is fed from the first control switch to the impedance to produce a feedback voltage on a terminal of the impedance, the feedback voltage is fed back to the comparator for comparison with a reference voltage, and the comparator produces a control voltage to control the first control switch for adjusting the first current;

a compensating circuit, comprising a negative threshold voltage transistor and a second control switch, wherein the negative threshold voltage transistor and the second control switch are serially connected between the power voltage and feedback voltage, wherein the negative threshold voltage transistor is turned on only when an operational condition of the voltage regulating circuit is at a fast-fast corner (FF), wherein the control voltage controls the second control switch to generate a second current added to the first current and fed into the impedance; and an output circuit, comprising a third control switch and a fixed current source, wherein the third control switch and the fixed current source are serially connected between the power voltage and the ground voltage, wherein the control voltage controls the third control switch to generate a regulating voltage between the third control switch and the fixed current source.

2. The voltage regulating circuit as claimed in claim 1, wherein the first control switch is a transistor switch, and the transistor switch is turned on when the first current is produced in the reference voltage generator.

3. The voltage regulating circuit as claimed in claim 2, wherein the transistor switch is also a negative threshold voltage transistor.

4. The voltage regulating circuit as claimed in claim 1, wherein the power voltage respectively applied to the reference voltage generator, the compensating circuit and the output circuit is same or different.

5. The voltage regulating circuit as claimed in claim 1, wherein the first control switch of the reference voltage generator is a first transistor switch and has a second source terminal, a second drain terminal, and a second gate terminal, wherein the second source terminal receives the power voltage, and the second gate terminal is connected to the output terminal of the comparator, and wherein the first terminal of the impedance is connected to the second drain terminal.

6. The voltage regulating circuit as claimed in claim 5, wherein the second control switch of the compensating circuit is a second transistor switch.

7. The voltage regulating circuit as claimed in claim 6, wherein at least one of the first transistor switch and the second transistor switch is a negative threshold voltage transistor.

8. The voltage regulating circuit as claimed in claim 6, wherein the third control switch of the output circuit is a third transistor switch having a third source terminal, a third drain terminal, and a third gate terminal, wherein the third source terminal receives the power voltage, the third gate terminal is connected to the output terminal of the comparator, and the third drain terminal is connected to the fixed current source.

9. The voltage regulating circuit as claimed in claim 8, wherein at least one of the first transistor switch, the second transistor switch, and the third transistor switch is a negative threshold voltage transistor.

10. The voltage regulating circuit as claimed in claim 8, wherein the power voltage respectively applied to the reference voltage generator, the compensating circuit and the output circuit is same or different.

11. The voltage regulating circuit as claimed in claim 1, wherein the negative threshold voltage transistor is turned on and produces a second current under the operational condition at the FF corner that an N-type transistor has a high dopant concentration.

12. The voltage regulating circuit as claimed in claim 1, wherein a current flowing through the impedance is a sum of the first current and the second current in stable state, to compensate a current offset caused by a high dopant concentration as fabricated.

* * * * *